US007270111B2

(12) United States Patent
Grybush et al.

(10) Patent No.: US 7,270,111 B2
(45) Date of Patent: Sep. 18, 2007

(54) COMPOSITE ENGINE SPEED CONTROL

(75) Inventors: Anthony F. Grybush, Kiel, WI (US); James G. Leu, Kiel, WI (US); Stephen T. Davis, Green Bay, WI (US); William H. Atkinson, New Holstein, WI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 11/346,906

(22) Filed: Feb. 3, 2006

(65) Prior Publication Data

US 2007/0181100 A1 Aug. 9, 2007

(51) Int. Cl.
*F02D 11/04* (2006.01)
*B06K 26/00* (2006.01)

(52) U.S. Cl. ..... 123/400; 74/482; 123/376

(58) Field of Classification Search ..... 123/400, 123/376, 366, 403, 342; 74/482, 502.4
See application file for complete search history.

(56) References Cited

U.S. PATENT DOCUMENTS

| | | | | | |
|---|---|---|---|---|---|
| 1,533,548 | A | * | 4/1925 | Hazelton | 74/606 R |
| 3,508,454 | A | | 4/1970 | Fanslow et al. | 74/482 |
| 3,869,937 | A | | 3/1975 | Ahrens | 74/482 |
| 4,108,120 | A | | 8/1978 | Woelffer | 123/103 B |
| 4,283,965 | A | | 8/1981 | Hansen | 74/482 |
| 4,315,871 | A | | 2/1982 | Pape | 261/65 |
| 4,351,198 | A | | 9/1982 | Hansen | 74/482 |
| 4,502,348 | A | | 3/1985 | Bauer | 74/482 |
| 4,517,942 | A | | 5/1985 | Pirkey et al. | 123/376 |
| 4,620,575 | A | | 11/1986 | Cuba et al. | 180/307 |
| 4,643,148 | A | | 2/1987 | Jedrziewski | 123/376 |
| 4,773,371 | A | | 9/1988 | Stenz | 123/376 |
| 4,898,039 | A | | 2/1990 | Aiyama et al. | 74/6 |
| 4,909,218 | A | * | 3/1990 | Uuskallio | 123/400 |
| 5,113,825 | A | * | 5/1992 | Takahashi | 123/400 |
| 5,163,401 | A | | 11/1992 | Reese | 123/376 |
| 5,738,069 | A | * | 4/1998 | St. Pierre et al. | 123/342 |
| 6,014,954 | A | | 1/2000 | Kleeman et al. | 123/339.13 |
| 6,039,024 | A | | 3/2000 | Carlson et al. | 123/396 |
| 6,439,547 | B1 | | 8/2002 | King et al. | 261/52 |
| 6,467,564 | B1 | | 10/2002 | Fava et al. | 180/336 |
| 6,520,489 | B1 | | 2/2003 | Morris | 261/65 |
| 6,561,496 | B2 | | 5/2003 | Gliniecki et al. | 261/52 |
| 6,651,524 | B2 | | 11/2003 | Dawson, Jr. et al. | 74/513 |
| 6,666,187 | B2 | | 12/2003 | Dahlberg et al. | 123/398 |
| 6,729,298 | B1 | | 5/2004 | Sterr | 123/339.13 |

* cited by examiner

*Primary Examiner*—Willis R. Wolfe
*Assistant Examiner*—Johnny H. Hoang
(74) *Attorney, Agent, or Firm*—Baker & Daniels LLP

(57) ABSTRACT

A common engine speed control mechanism for small internal combustion engines, which may be configured to allow for actuation of the speed control mechanism between stop, idle, and various engine running speed positions by actuation of one of a selected plurality of speed control levers. Each of the plurality of speed control levers is oriented so that it is movable in a direction which is substantially non-parallel to the direction of movement of the other speed control levers. In one embodiment, the actuation of the common speed control mechanism can be accomplished by movement of a first speed control lever in a substantially horizontal, side-to-side direction or by movement of a second speed control lever in a substantially vertical, up-and-down direction.

20 Claims, 12 Drawing Sheets

COMPOSITE ENGINE SPEED CONTROL

BACKGROUND OF THE INVENTION

1. Field of the Invention

The present invention relates to small internal combustion engines of the type used with lawnmowers, lawn tractors, other utility implements, and in sport vehicles, for example and, in particular, relates to speed control mechanisms for such engines.

2. Description of the Related Art

Small internal combustion engines typically include a carburetor which supplies an air/fuel mixture to one or more combustion chambers of the engine for combustion to drive the piston(s) and the crankshaft of the engine. The engine speed is typically regulated by a throttle valve disposed within the intake passage of the carburetor, which is movable between a substantially closed position corresponding to the engine being stopped or the engine running at a low or idle speed, and a substantially open position, corresponding to the engine running at its running speed.

Many small internal combustion engines also include a governor for maintaining a desired running speed of the engine, including a mechanical governor mechanism disposed within the crankcase and driven from the crankshaft. The governor mechanism may include one or more flyweights movable responsive to engine speed, which actuate a governor arm within the crankcase and a governor lever disposed externally of the crankcase. The governor lever is linked to the throttle valve of the carburetor. In operation, when the engine speed falls below a desired running speed, such as when a load is imposed upon the engine, the governor operates to further open the throttle valve of the carburetor to increase the engine speed. When the engine speed increases beyond a desired running speed, such as when a load is removed from the engine, the governor operates to further close the throttle valve of the carburetor to decrease the engine speed.

Many small internal combustion engines also include a speed control mechanism which is operable by an operator to set the running speed of the engine. The speed control mechanism includes a speed control lever which may be disposed either near the engine itself, or on the handle of an implement with which the engine is used. The speed control lever is movable between stop, idle, and various running speed positions, for example, to set the engine speed. When the speed control lever is disposed in the stop position, the throttle valve of the carburetor is substantially fully closed. When the speed control lever is disposed in the idle position, the throttle valve of the carburetor is slightly open to maintain a low engine running speed. When the speed control lever is moved through the various running speed positions toward a high speed position, the throttle valve is progressively opened to provide progressively higher engine running speeds. When the throttle lever is positioned to establish a desired running speed, that running speed is maintained by the governor responsive to engine load in the manner described above.

In small internal combustion engines that include a speed control mechanism, the speed control mechanism is typically oriented entirely in a substantially horizontal or a substantially vertical plane, wherein actuating movement of the speed control lever of the speed control mechanism occurs in the same plane. For example, the speed control lever for a horizontally mounted speed control mechanism is operable to adjust the speed control mechanism between stop, idle, and the various running speed positions by movement of the speed control lever in a substantially horizontal, side-to-side direction. Similarly, the speed control lever for a vertically mounted speed control mechanism is operable to adjust the speed control mechanism between stop, idle, and the various running speed positions by movement of the speed control lever in a substantially vertical, up-and-down direction.

One disadvantage of known speed control mechanisms is that the orientation of the speed control level is dictated by the orientation of the speed control mechanism. Often, a horizontally mounted speed control lever is desirable for applications such as go-karts, garden tillers, and other similar applications, while a vertical speed control lever orientation is desirable for snow throwers or other applications. Therefore, for different engine types, one speed control mechanism must be designed for mounting for horizontal, side-to-side actuation and a different speed control mechanism must be designed for vertical, up-and-down actuation, necessitating increased cost and increased total parts and inventory.

What is needed is a speed control mechanism for small internal combustion engines which is an improvement over the foregoing.

SUMMARY OF THE INVENTION

The present invention provides a common engine speed control mechanism for small internal combustion engines, which may be configured to allow for actuation of the speed control mechanism between stop, idle, and various engine running speed positions by actuation of one of a selected plurality of speed control levers. Each of the plurality of speed control levers is oriented so that it is movable in a direction which is substantially non-parallel to the direction of movement of the other speed control levers. In one embodiment, the actuation of the common speed control mechanism can be accomplished by movement of a first speed control lever in a substantially horizontal, side-to-side direction or by movement of a second speed control lever in a substantially vertical, up-and-down direction.

In one embodiment, the speed control lever forms a right angle interface with the speed control mechanism. This interface facilitates the conversion of motion in a first plane to motion in a second, transverse plane. In one embodiment, the right angle interface utilizes a combination of links and pivots. In another embodiment, the right angle interface is a pin and slot connection. In another embodiment, the right angle interface is a rack and pinion gear mesh.

Each of the embodiments disclosed herein advantageously allows the speed control mechanism of a small internal combustion engine to be adjusted by the movement of either of a plurality of speed control levers along respective non-parallel axes or directions. The present system allows for a single, common speed control mechanism to be used with different engines by selectively configuring the common speed control mechanism based on the intended use of the engine. For example, the speed control mechanism, when configured for use with an internal combustion engine in a snow thrower, may have an operator control element interface attached to a vertical speed control lever to allow the operator to control the speed of the engine by vertical, up-and-down movement of the operator control element interface. Alternatively, the speed control mechanism, when configured for use with an internal combustion engine in a go-kart, may have an operator control element interface attached to a horizontal speed control lever to allow for the operator to control the speed of the engine by horizontal, side-to-side movement of the operator control element interface.

In one form thereof, the present invention provides an internal combustion engine, including a support, a speed control lever pivotally mounted to the support, the speed control lever including at least first and second operator control element interfaces, and an operator control element connected to one of the operator control element interfaces, the operator control element movable to pivot the speed control lever with respect to the support.

In another form thereof, the present invention provides a speed control assembly kit for an internal combustion engine, including a support, a speed control lever pivotally mounted to the support, a first operator control element connected to the speed control lever for movement of the first operator control element and the speed control lever in substantially the same plane, and a second operator control element connectable to the speed control lever for movement of the second operator control element and the speed control lever within substantially perpendicular planes.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplifications set out herein illustrate preferred embodiments of the invention and such exemplifications is not to be construed as limiting the scope of the invention any manner.

DETAILED DESCRIPTION

Figure 1A:
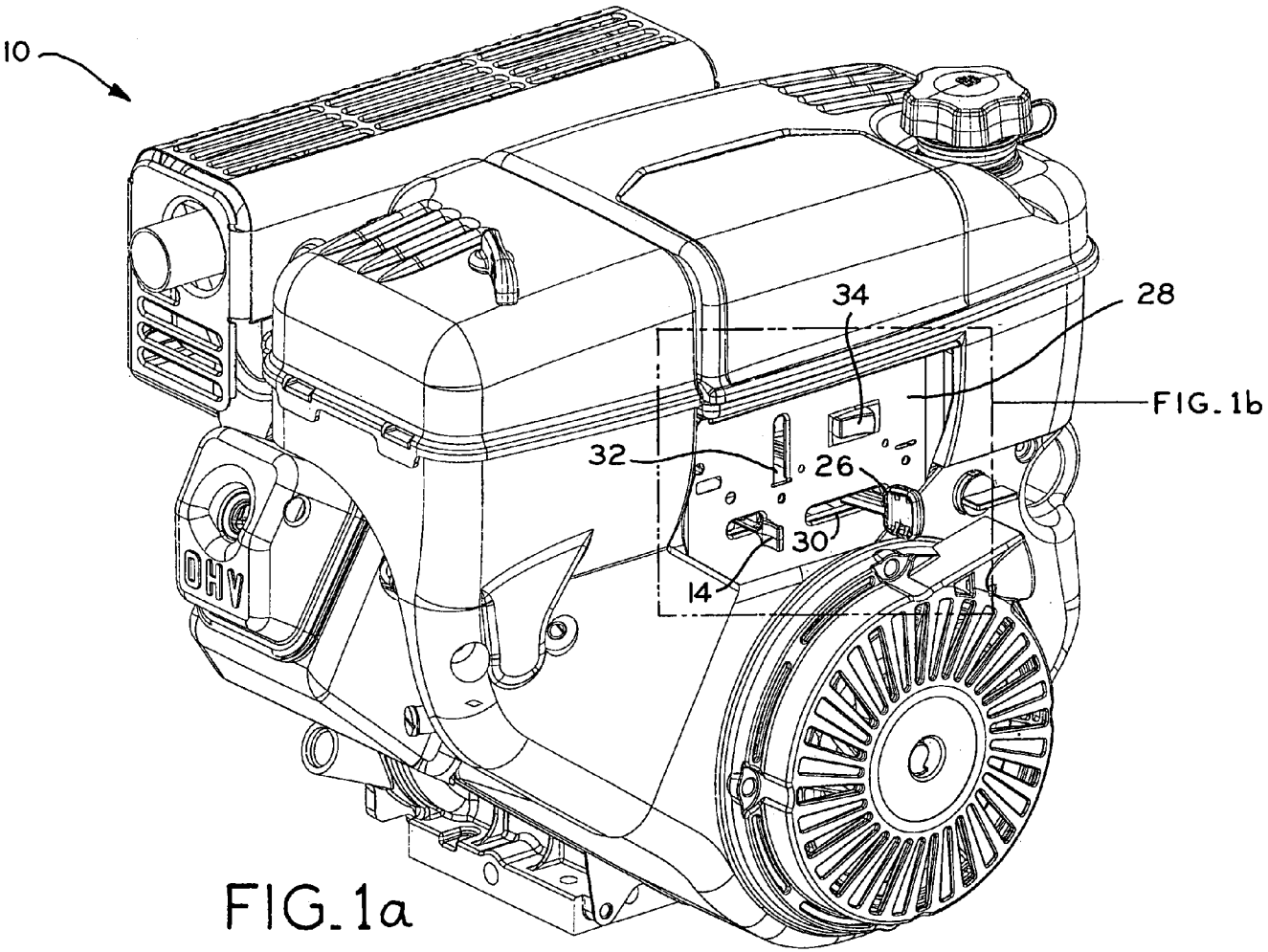
FIG. 1*a* is a perspective view of a small internal combustion engine showing an operator control element interface attached to a horizontal speed control lever.

Referring to FIGS. 1*a*-2*b*, a small internal combustion engine 10 is shown, including a speed control mechanism according to the present invention.

Engine 10 may be of the type of small internal combustion engines manufactured by Tecumseh Power Company of Grafton, Wis., and includes known components not visible in the figures, including a crankcase and a cylinder block attached to the crankcase, with the cylinder block including one or more bores which receive pistons. Each piston is connected to the crankshaft of engine 10 via a connecting rod. Engine 10 is shown herein as a horizontal crankshaft engine; however, the present invention is equally applicable to vertical crankshaft engines. Some exemplary engines with which the present speed control mechanism, described below, may be used are disclosed in U.S. Pat. Nos. 6,295,959, 6,612,275, and 6,941,914, each assigned to the assignee of the present invention, the disclosures of which are hereby incorporated by reference. Engine 10 is of the type used in utility implements such as snow throwers, lawn mowers, and other utility implements, for example, the implement typically including a frame (not shown) to which engine 10 is attached. For example, when the implement is a snow thrower, engine 10 is mounted to a deck (not shown) which includes two or more wheels, and drives an auger mechanism. When engine 10 is used with a lawn mower, engine 10 is mounted to a deck (not shown) including wheels, and engine 10 drives a rotating cutting blade beneath the deck.

Engine 10 includes a carburetor (not shown) connected to engine 10 in fluid communication with the combustion chamber(s) of the engine cylinder(s) to supply an air/fuel combustion mixture to engine 10 for combustion. The carburetor generally includes an intake air passage that extends from an inlet end of the carburetor to an outlet end of the carburetor which is in communication with combustion chamber(s) of the engine cylinder(s). The carburetor additionally includes a venturi section and a throttle valve rotatably mounted within the throat. Optionally, the carburetor may include a rotatable choke valve (not shown) controlled by choke valve lever 12, shown in FIG. 3, movable by actuation of a choke valve operator interface, depicted as knob 14.

Engine 10 additionally includes a governor device for regulating and/or maintaining a set running speed of engine 10. The governor device of engine 10 is similar to those disclosed in U.S. Pat. Nos. 4,517,942 and 5,163,401, each assigned to the assignee of the present invention, the disclosures of which are expressly incorporated herein by reference. The governor device is driven from the crankshaft or from the camshaft of engine 10 and responds to increases and decreases in engine speed by rotating governor lever 16, shown in FIG. 3, a small distance. Governor lever 16 is linked to the throttle valve of the carburetor in a known manner, such as via link 18, so that movement of governor lever 16 results in corresponding movement of the throttle valve of the carburetor.

Figure 3:
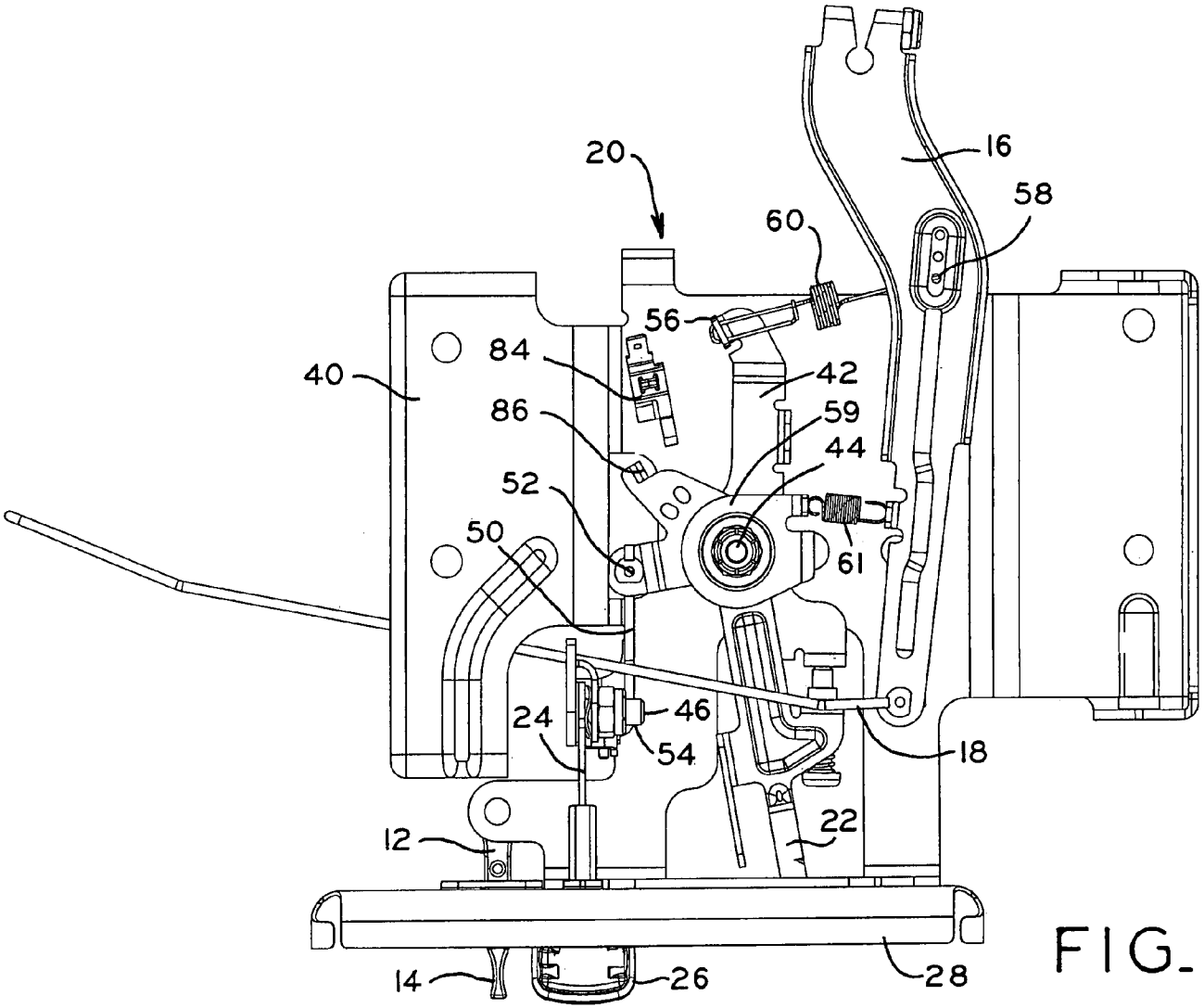
FIG. 3 is a top plan view of a speed control mechanism including an operator control element interface positioned as depicted in the internal combustion engine of FIGS. 2*a* and 2*b;*
Figure 4:
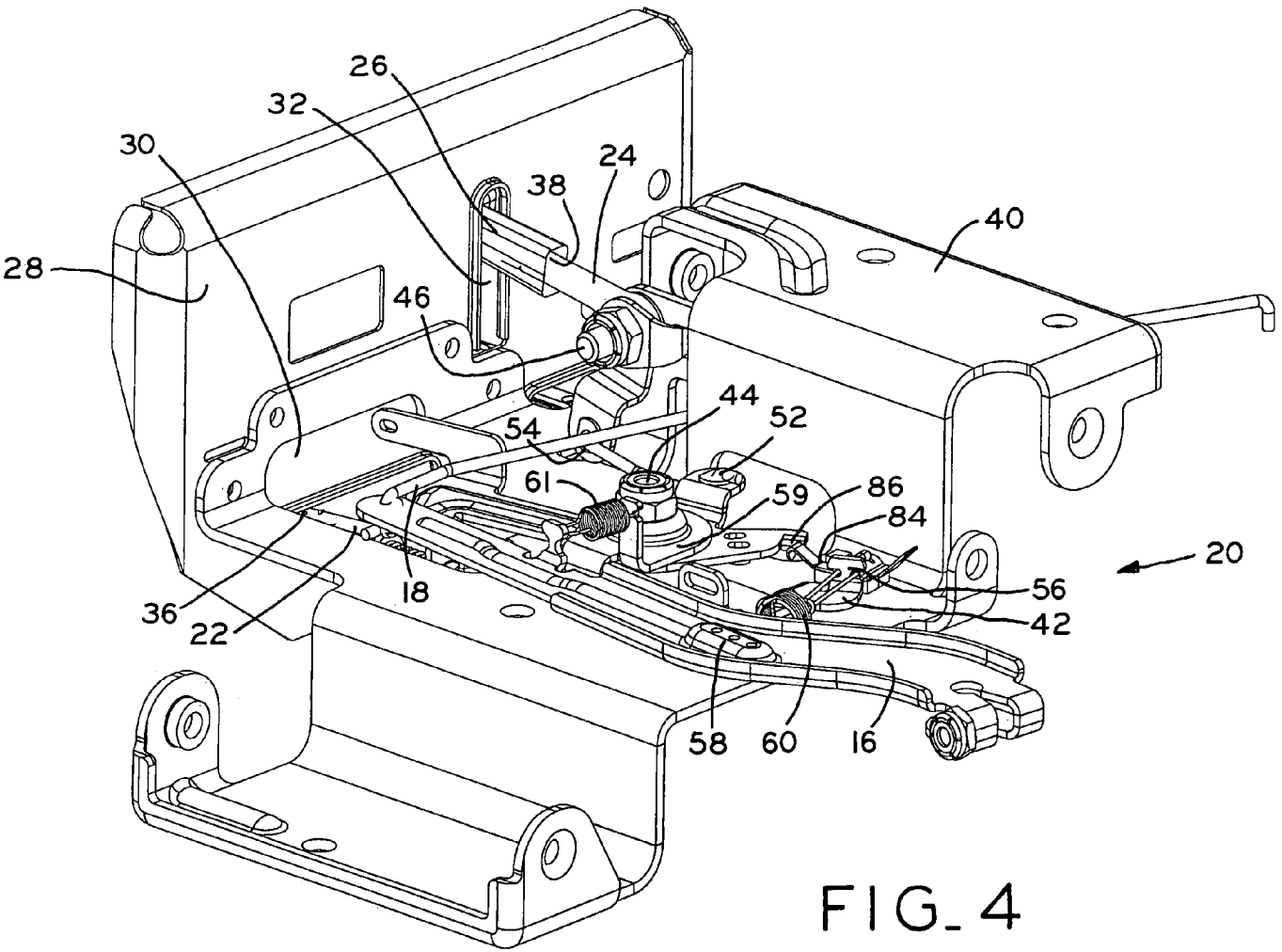
FIG. 4 is a perspective view of the speed control mechanism.

Additionally, governor lever 16 can be rotated, and the throttle valve of the carburetor correspondingly rotated as described above, by movement of speed control mechanism 20, shown in FIG. 3. In this manner, movement of speed control mechanism 20 is translated into an increase or decrease in the running speed of engine 10. Speed control mechanism 20 includes a primary speed control lever 22 and a secondary speed control lever 24 connected thereto via a right-angle connection, for example, as described below. Primary speed control lever 22 and secondary speed control lever 24 are oriented so that horizontal, side-to-side movement and vertical, up-and-down movement of speed control levers 22, 24, respectively, corresponds to movement of speed control mechanism 20, as described below. Secondary speed control lever 24 can be connected to speed control mechanism 20 by various angled connections, including, as described in detail below, links and pivots, a pin and slot connection, or a rack and pinion gear mesh.

Figure 5:
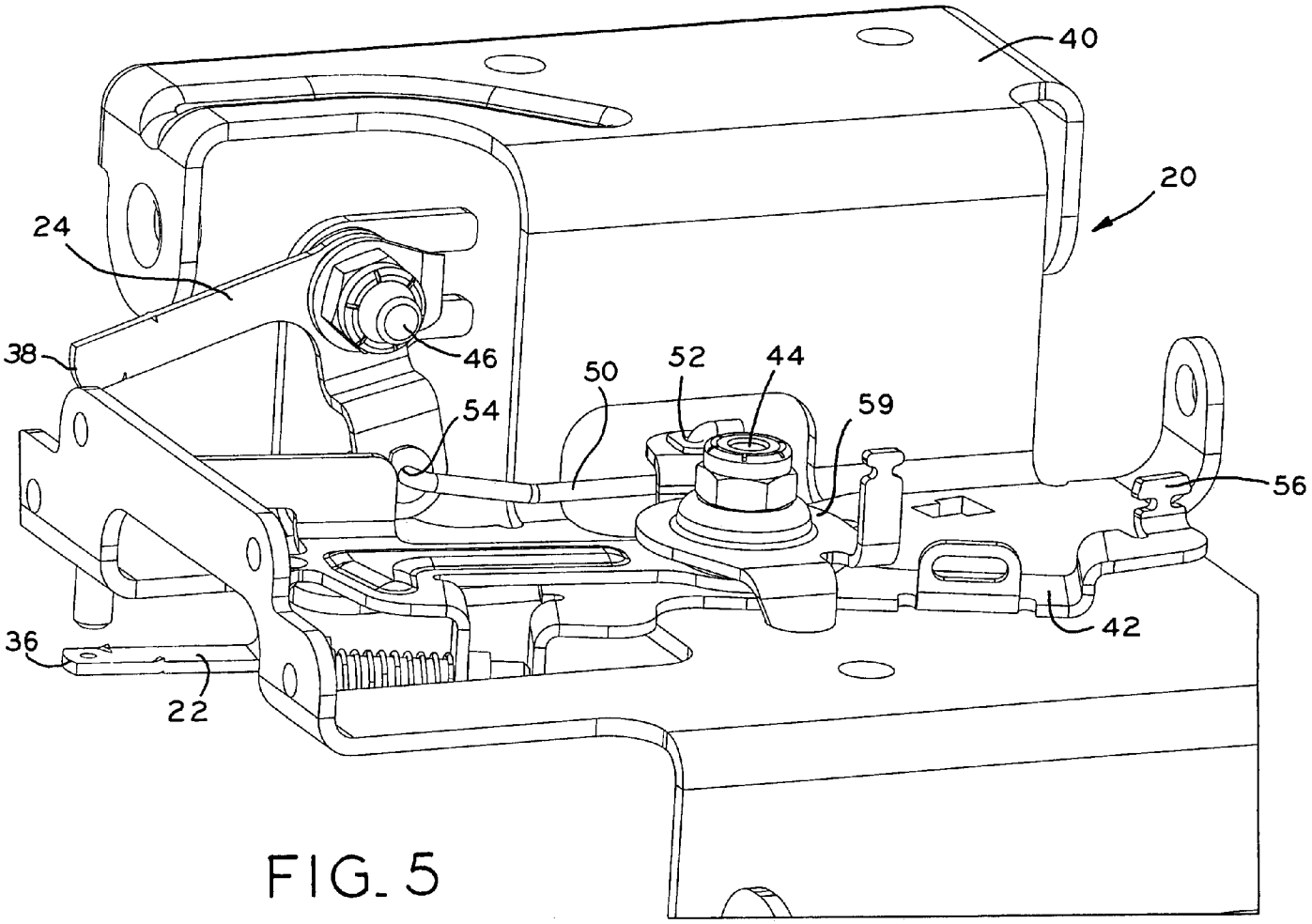
FIG. 5 is a perspective view of the speed control mechanism, with the speed control mechanism in an engine stop position.

An operator control element, depicted as knob 26 in FIGS. 1*a*-3, can be attached to one or both speed control levers 22, 24. As shown in FIGS. 1*a*-2*b*, engine 10 includes control panel 28, including slots 30, 32, on/off switch 34, and choke valve lever 14. Referring to FIG. 5, knob 26 can be connected to operator control element interface 36 of primary control lever 22 so that knob 26 extends through slot 30, as shown in FIGS. 1*a* and 1*b*. Similarly, referring to FIG. 5, knob 26 can also be connected to operator control element interface 38 of secondary control lever 24 so that knob 26 extends through slot 32, as shown in FIGS. 2*a* and 2*b*. Additionally, to prevent dust and debris from entering through slots 30, 32, slots 30, 32 that lack knob 12 extending therethrough may have a decal or plate (not shown) covering slots 30, 32.

Referring to FIG. 3, details of speed control mechanism 20 will now be described. Speed control mechanism 20 includes many features similar to the speed control mechanism disclosed in U.S. Pat. No. 6,279,298 assigned to the assignee of the present invention, the disclosure of which is expressly incorporated herein by reference. Speed control mechanism 20 includes a support, shown herein as mount plate 40, which may be secured to the crankcase or to the cylinder block of engine 10 by suitable fasteners. Primary speed control lever 22 and governor actuator lever 42 are each rotatably mounted to mount plate 40 at pivot 44 via a lost motion-type connection. Secondary speed control lever 24 is mounted on pivot post 46 of mount plate 40. Primary speed control lever 22 and secondary speed control lever 24 are movable between the positions shown in FIGS. 5 and 6, with the positions corresponding to engine stop and high engine running speed positions, respectively. Throughout the foregoing positions of primary speed control lever 22, secondary speed control lever 24 and governor actuator lever 42 correspondingly rotate therewith.

Figure 1B:
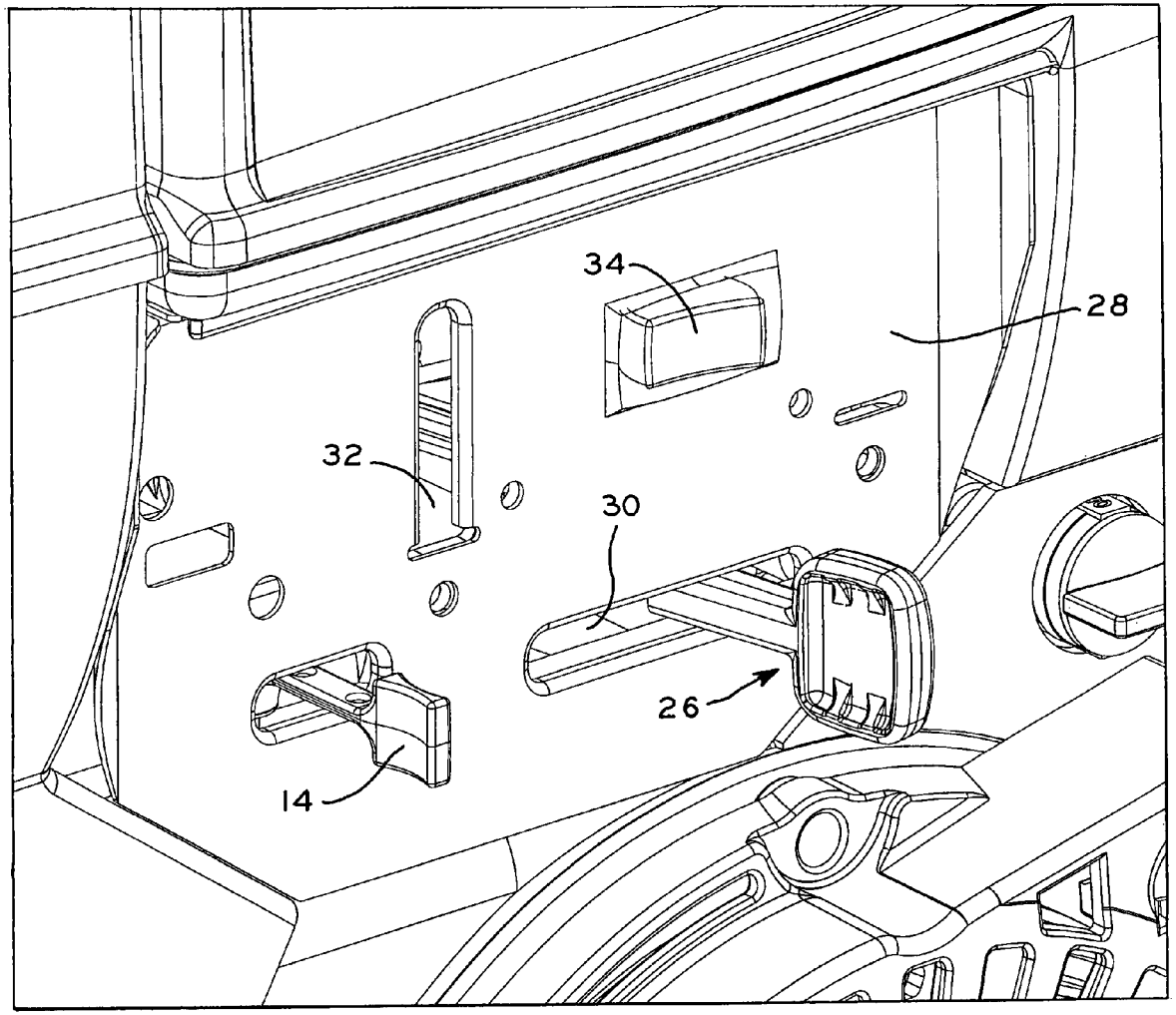
FIG. 1*b* is a fragmentary view of a portion of the engine of FIG. 1*a;*
Figure 9:
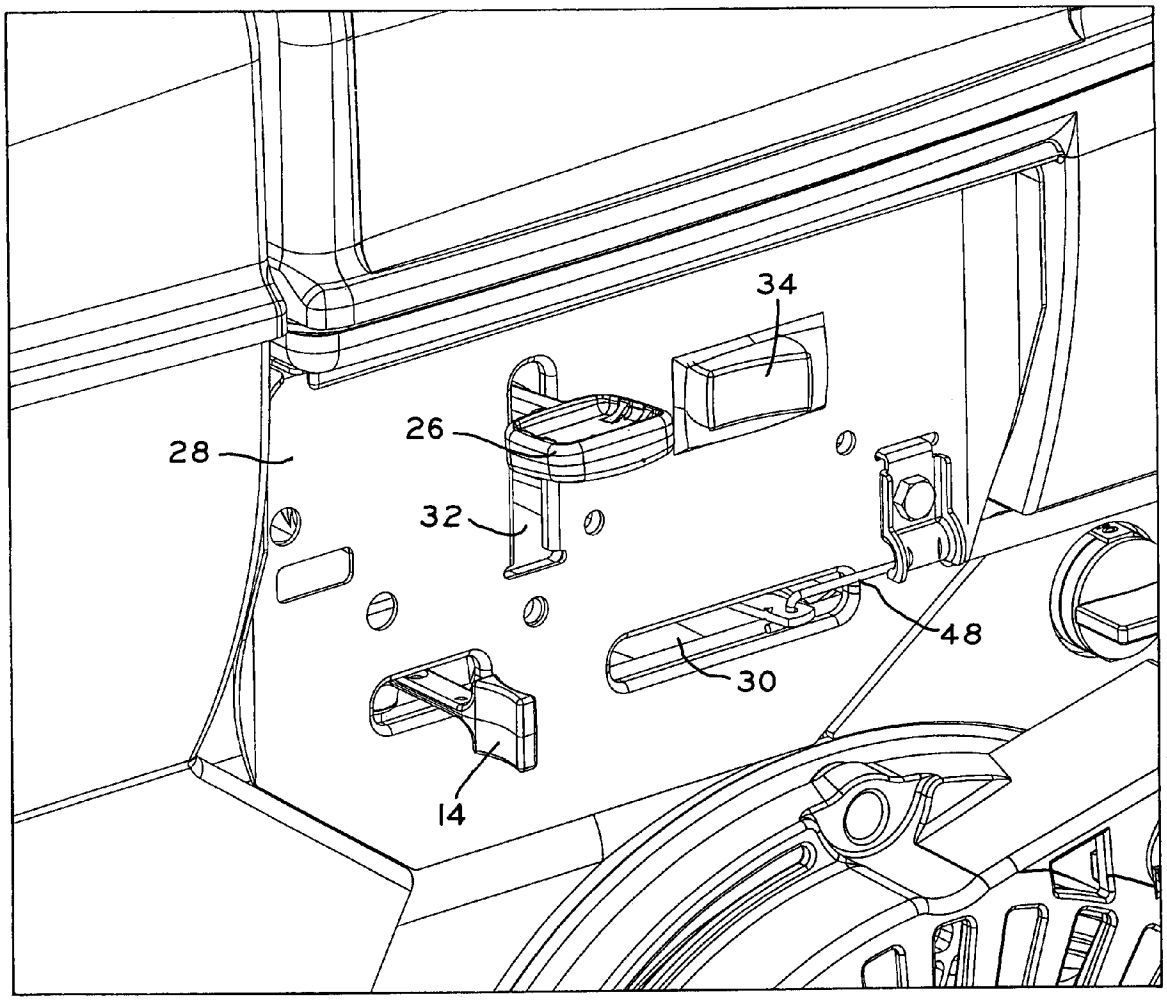
FIG. 9 is a fragmentary perspective view of a portion of an engine.

Primary speed control lever 22 may include knob 26, shown in FIGS. 1*a* and 1*b*, attached to operator control element interface 36. Knob 26 may be made of suitable plastic, for example, for grasping directly by an operator to rotate primary speed control lever 22. Alternatively, to provide for remote actuation of speed control levers 22, 24, the operator control element may be a Bowden-type cable 48, shown in FIG. 9, attached to primary speed control lever 22 or to secondary speed control lever 24. As shown in FIG. 3, primary speed control lever 22 is coupled to secondary speed control lever 24 via a right angle interface, comprising links 50 connected at pivots 52, 54. Governor actuator lever 42 is coupled to primary speed control lever 22 at pivot 44 and includes a first portion 56 extending generally upwardly. First portion 56 is connected to protrusion 58 of governor lever 16 via spring 60. Fixed plate 59 is connected to both primary speed control lever 22 and governor actuator lever 42 at pivot 44. Fixed plate 59 maintains tension on governor lever 16 via spring 61 connected thereto. Governor lever 16 is, as described in detail above, connected at a pivot point by link 18, which is connected to the throttle valve of the carburetor of engine 10.

Figure 2A:
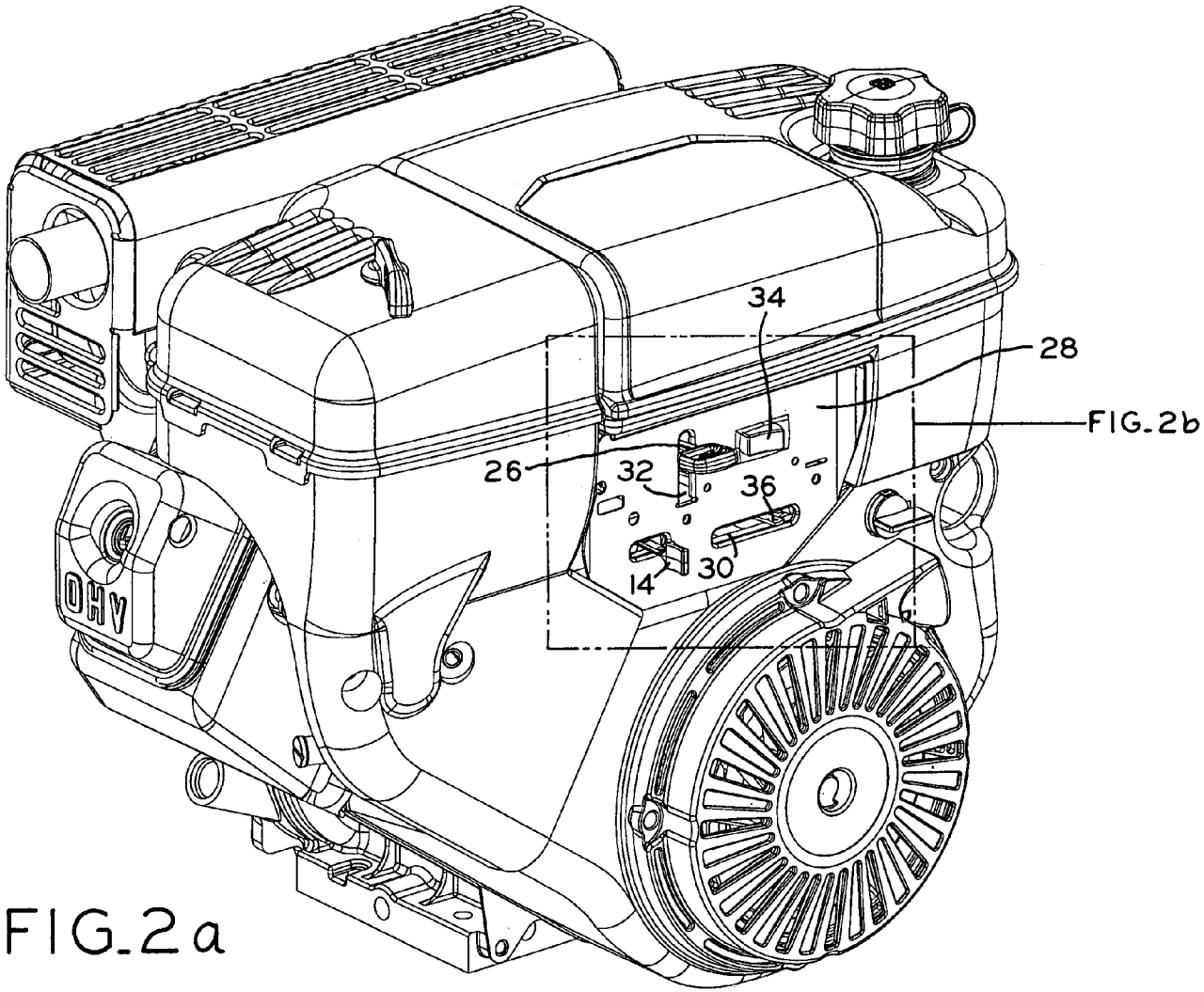
FIG. 2*a* is a perspective view of a small internal combustion engine showing an operator control element interface attached to a vertical speed control lever.
Figure 2B:
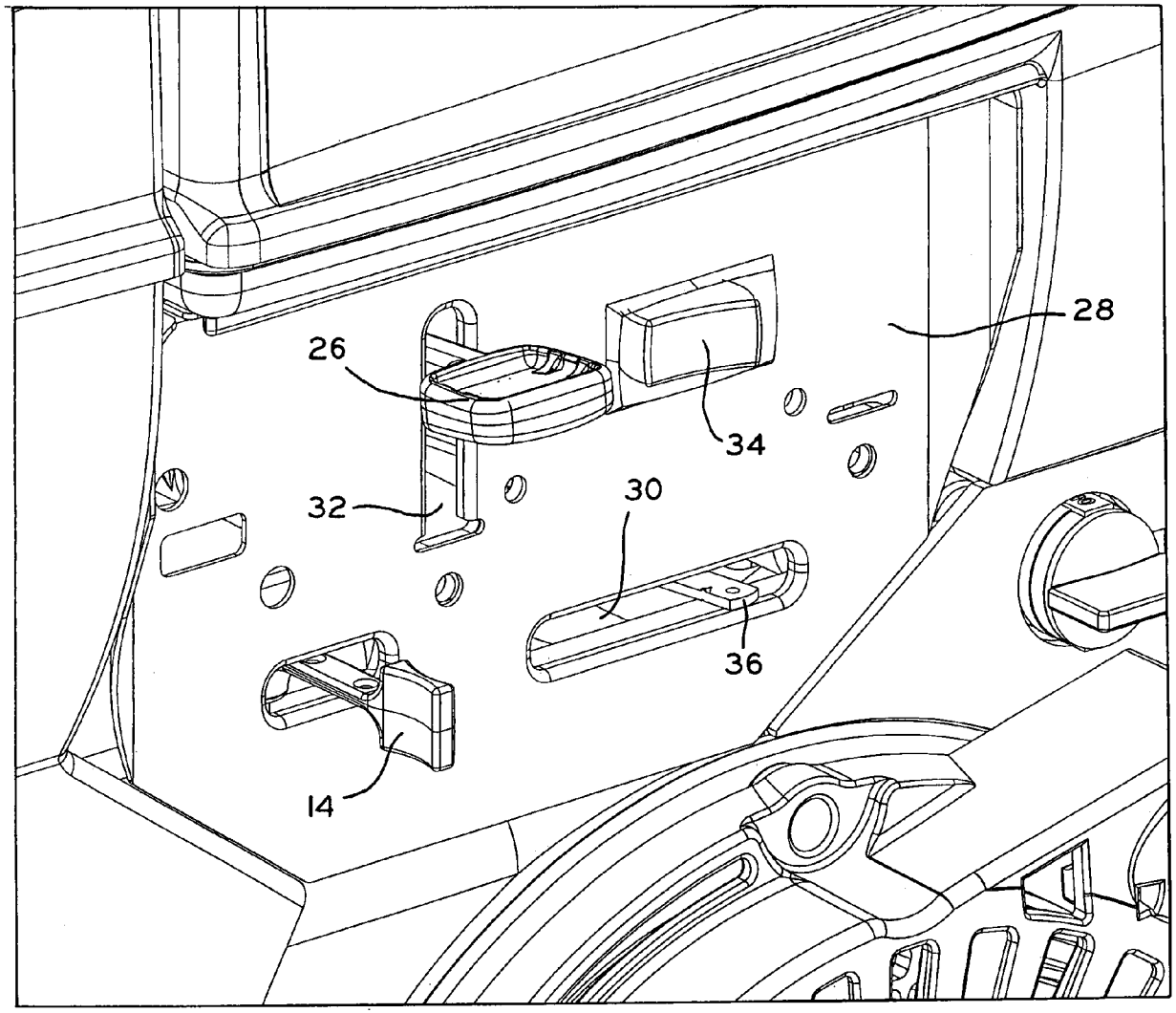
FIG. 2*b* is a fragmentary view of a portion of the engine of FIG. 2*a;*

Secondary speed control lever 24 may include knob 26, as shown in FIGS. 2*a* and 2*b*, which may be made of suitable plastic, for example, for grasping by an operator to rotate secondary speed control lever 24. As discussed above with reference to primary speed control lever 22, cable 48 could also be utilized with secondary speed control lever 24 to provide for remote actuation. As shown in FIG. 3, secondary speed control lever 24 may be coupled to primary speed control lever 22 by a right angle interface. In one embodiment, the right angle interface includes pivots 52, 54 and link 50. Pivots 52, 54 and link 50 cooperate to translate the vertical, up-and-down movement of secondary speed control lever 24 around pivot post 46 into horizontal, side-to-side movement rotating primary speed control lever 22.

Figure 6:
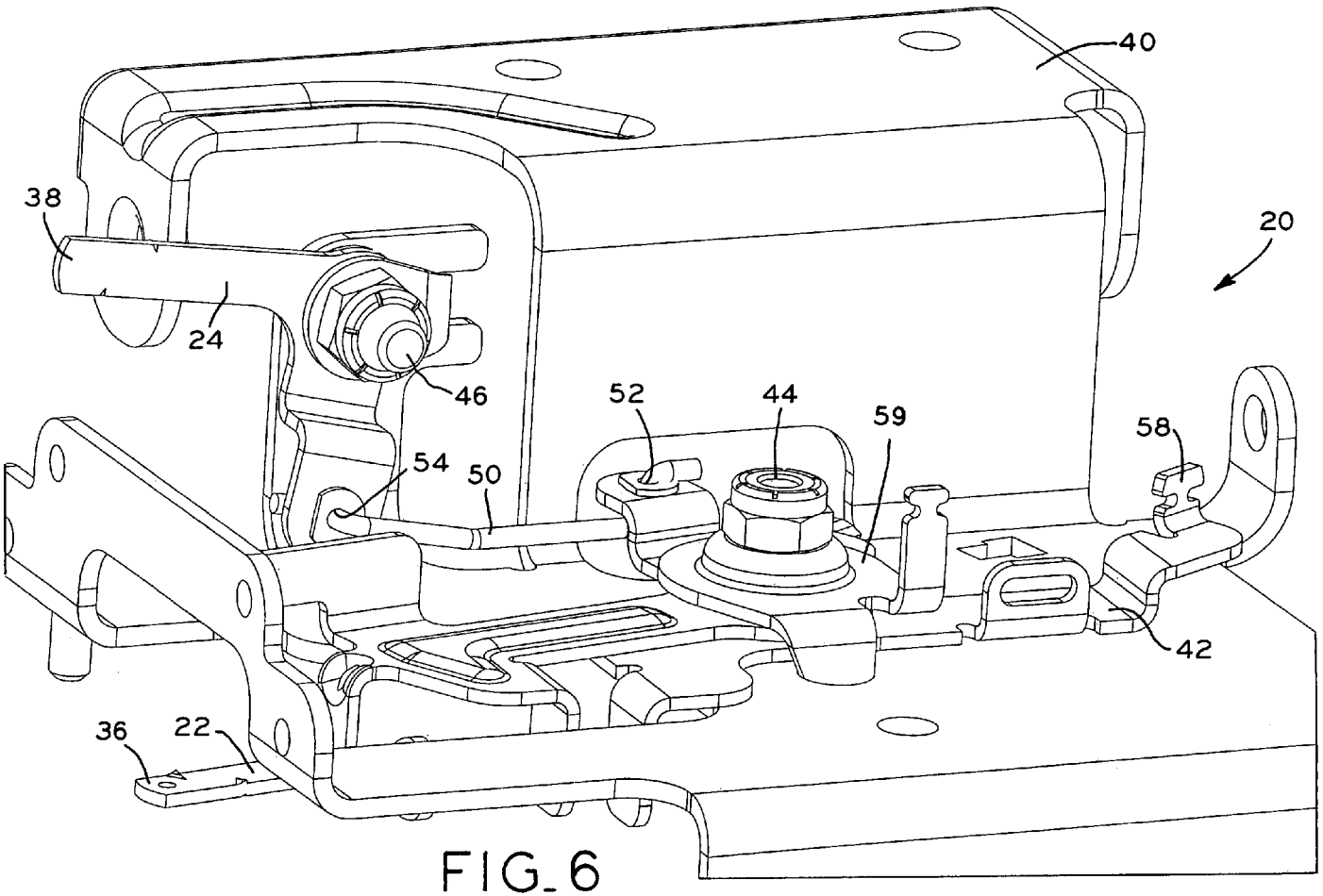
FIG. 6 is a continuation of FIG. 5, showing the speed control mechanism disposed in a high engine running speed position during normal operation of the engine.
Figure 7:
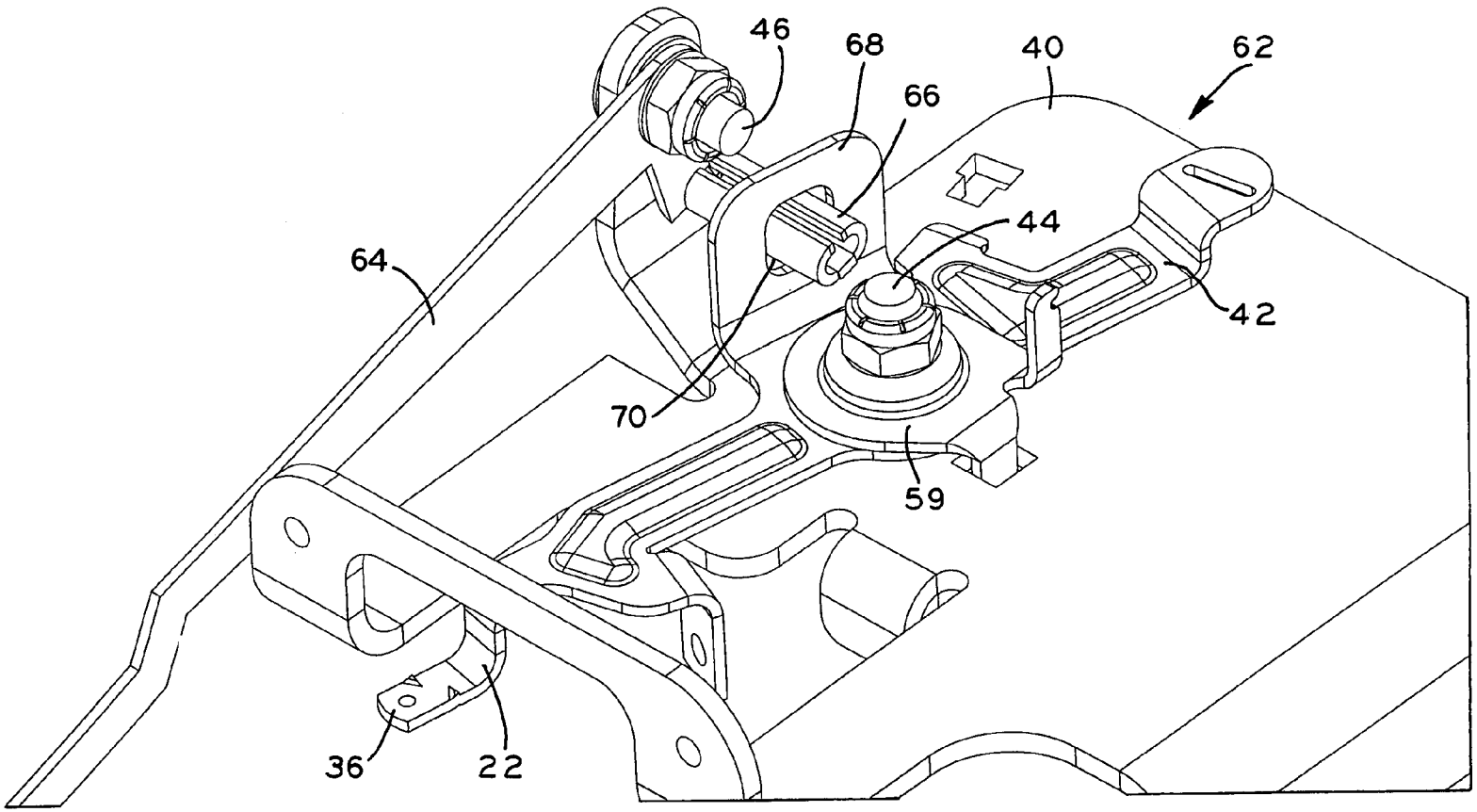
FIG. 7 is a fragmentary perspective view of the speed control mechanism, showing the speed control levers configured according to a second embodiment of the present invention with the speed control mechanism disposed in an engine stop position.
Figure 8:
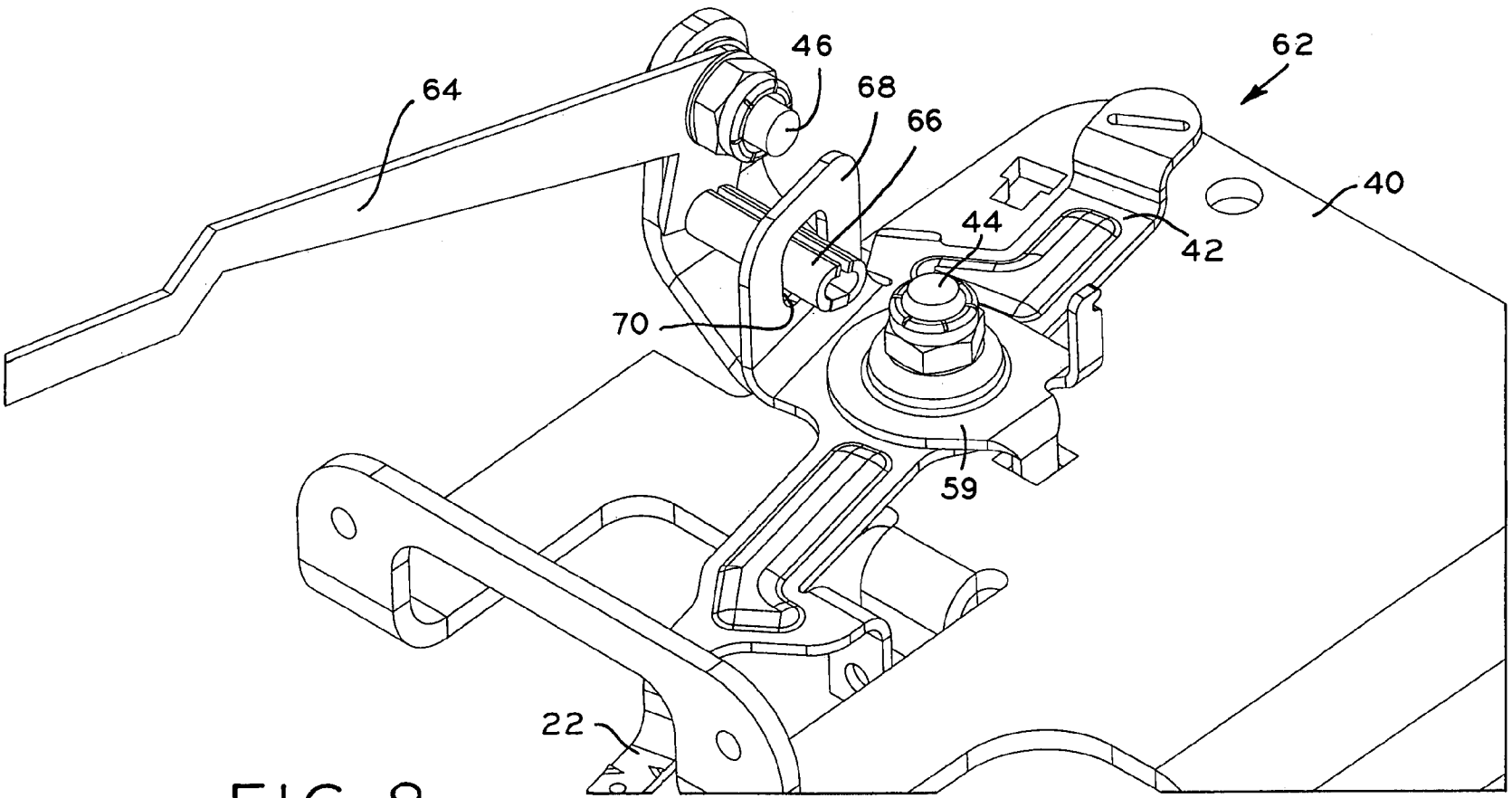
FIG. 8 is a continuation of FIG. 7, showing the speed control mechanism at a high engine run speed position.

FIGS. 7 and 8 depict another embodiment of the speed control mechanism of the present invention as speed control mechanism 62. Speed control mechanism 48 includes several components which are identical to the embodiments of FIGS. 1-6 discussed above and identical reference numerals have been used to indicate identical or substantially identical components therebetween. Referring to FIG. 7, secondary speed control lever 64 is attached to mount plate 40 at pivot post 46. Pin 66 extends substantially perpendicularly from secondary speed control lever 64. Primary speed control lever 22 includes plate 68 extending upwardly therefrom. Plate 68 includes slot 70 sized to accept pin 66 therein. Pin 66 is disposed through slot 70 in loose engagement therewith. When secondary speed control lever 64 is rotated about pivot post 46, pin 66 contacts portions of plate 68 defining slot 70, rotating plate 68, and, correspondingly, primary speed control lever 22 about pivot 46. FIG. 7 depicts speed control mechanism 62 in an engine stop position corresponding to engine 10 being stopped. FIG. 8 depicts speed control mechanism 62 in a high engine running speed position, as discussed in detail above.

Figure 10:
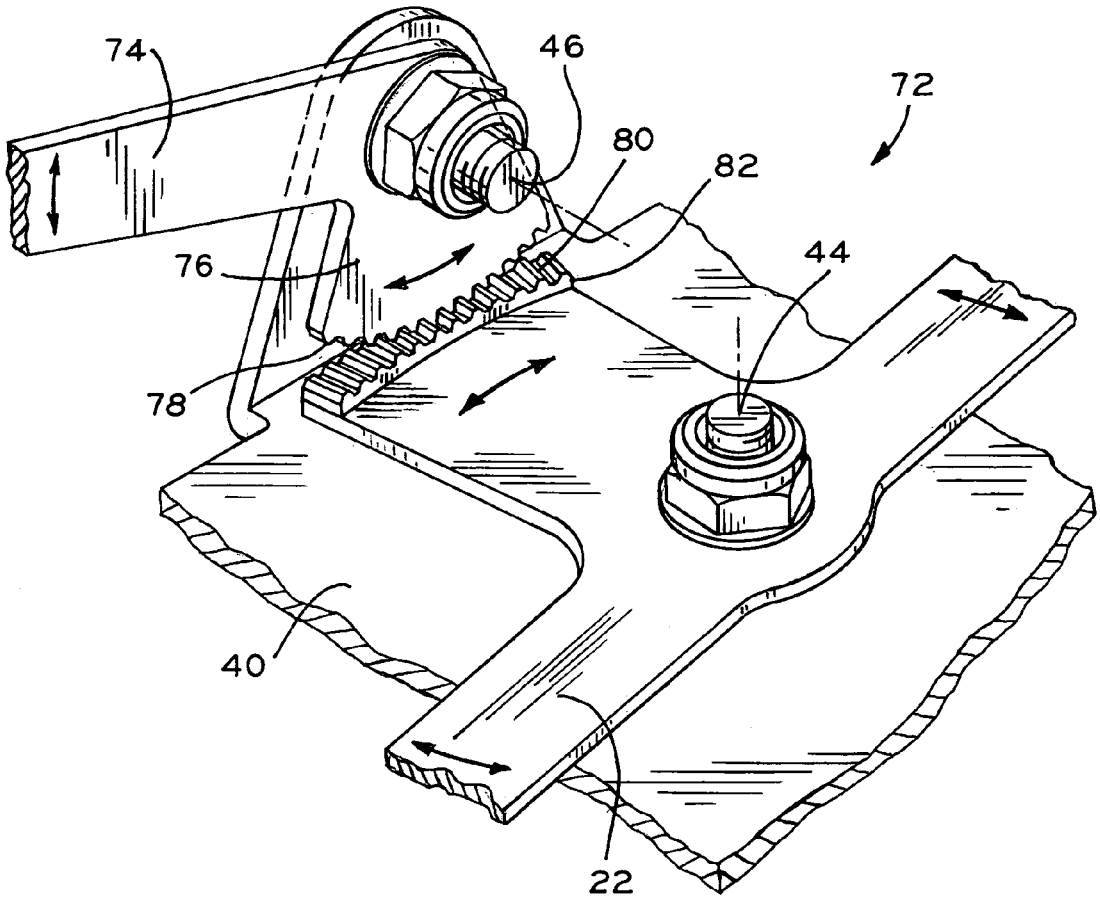
FIG. 10 is a fragmentary perspective view of the speed control mechanism, showing the speed control levers configured according to a third embodiment of the present invention.

FIG. 10 depicts another embodiment of the speed control mechanism of the present invention as speed control mechanism 72. Speed control mechanism 72 includes several components which are identical to the embodiments of FIGS. 1-6 discussed above and identical reference numerals have been used to indicate identical or substantially identical components therebetween. Referring to FIG. 10, secondary speed control lever 74 is attached to mount plate 40 at pivot post 46. Secondary speed control lever 74 includes pinion gear 76 including teeth 78. Teeth 78 mate with corresponding teeth 80 of rack 82 of speed control mechanism 72. When secondary speed control lever 74 is moved in a vertical, up-and-down direction, speed control mechanism 72 rotates in the direction indicated by the arrows in FIG. 10.

Referring to FIGS. 5 and 6, operation of speed control mechanism 20, including primary speed control lever 22 and secondary speed control lever 24, will now be described. In FIG. 5, speed control mechanism 20 is shown with primary speed control lever 22 and secondary speed control lever 24 at an engine stop position corresponding to engine 10 being stopped. In this position, primary speed control lever 22 is rotated clockwise, and secondary speed control lever 24 is rotated downward, to their furthest extents. Additionally, ignition switch 84 is touching contact 86, which grounds the ignition system of engine 10 preventing engine 10 from starting. When an operator desires to start engine 10, the operator moves primary speed control lever 22 counter-clockwise, or moves secondary speed control lever 24 upward, to an idle position (not shown) to slightly open the throttle valve as described above and move contact 86 away from ignition switch 84. Regardless of which speed control lever 22, 24 the operator moves, the position of both speed control levers will be correspondingly changed via the above-described linkage. The operator then actuates a pull-recoil starting mechanism (not shown) or an electric starter motor (not shown) to crank engine 10, thereby drawing an air/fuel mixture into the carburetor for starting engine 10. Optionally, the operator may actuate a primer mechanism (not shown) associated with the carburetor to supply an amount of priming fuel to the carburetor to aid in starting engine 10.

After the engine starts, the operator moves primary speed control lever 22 counterclockwise, or moves secondary speed control lever 24 upward, from the idle position to a desired engine running speed position, which is shown in FIG. 6 as a high engine running speed position. For small internal combustion engines, normal high engine running speeds are typically between 1600 and 1400 rpm. In the high engine running speed position of primary speed control lever 22 and secondary speed control lever 24, shown in FIG. 6, the above described linkage positions the throttle valve of the carburetor in a substantially open position, allowing a relatively large degree of intake air flow through the carburetor allowing engine 10 to run at a high speed.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A speed control assembly for an internal combustion engine, comprising:

a support;

a primary speed control lever pivotally mounted to said support, said primary speed control lever including at least first and second operator control element interfaces; and an operator control element connected to only one of said operator control element interfaces, said operator control element movable to pivot said primary speed control lever with respect to said support.

2. The speed control assembly of claim 1, wherein said operator control element comprises a manually actuable knob.

3. The speed control assembly of claim 1, wherein said operator control element comprises a cable.

4. The speed control assembly of claim 1, wherein said first operator control element interface comprises an end of said primary speed control lever, said operator control element connected to said end, wherein said operator control element and said primary speed control lever are together movable in substantially the same plane.

5. The speed control assembly of claim 1, wherein said second operator control element interface comprises a right angle connection, said operator control element connected via said right angle connection to primary said speed control lever wherein said operator control element and said primary speed control lever are movable within substantially perpendicular planes.

6. The speed control assembly of claim 5, wherein said right angle connection comprises a pin and slot connection.

7. The speed control assembly of claim 5, wherein said right angle connection comprises a rack and pinion gear mesh.

8. The speed control assembly of claim 1, wherein said operator control element comprises a secondary speed control lever connected to said primary speed control lever, said secondary speed control lever pivotally mounted to said support for movement within a plane perpendicular to a plane within which said primary speed control lever is movable.

9. A speed control assembly for an internal combustion engine, comprising:

a support;

a primary speed control lever pivotally mounted to said support, said primary speed control lever including at least first and second operator control element interfaces; and an operator control element connected to one of said operator control element interfaces, said operator control element movable to pivot said primary speed control lever with respect to said support, said operator control element comprising a secondary speed control lever connected to said primary speed control lever, said secondary speed control lever pivotally mounted to said support for movement within a plane perpendicular to a plane within which said primary speed control lever is movable, said secondary speed control lever pivotally mounted to said primary speed control lever via:

a slot formed on one of said secondary control lever and said primary speed control lever; and a pin formed on the other of said secondary speed control lever and said primary speed control lever, said pin engaged within said slot.

10. A speed control assembly for an internal combustion engine, comprising:

a support;

a primary speed control lever pivotally mounted to said support, said primary speed control lever including at least first and second operator control element interfaces; and an operator control element connected to one of said operator control element interfaces, said operator control element movable to pivot said primary speed control lever with respect to said support, said operator control element comprising a secondary speed control lever connected to said primary speed control lever, said secondary speed control lever pivotally mounted to said support for movement within a plane perpendicular to a plane within which said primary speed control lever is movable, said secondary speed control lever pivotally mounted to said primary speed control lever via:

a rack attached to one of said secondary speed control lever and said primary speed control lever; and a pinion attached to the other of said secondary speed control lever and said primary speed control lever, said pinion engaged within said rack.

11. A speed control assembly kit for an internal combustion engine, comprising:

a support;

a primary speed control lever pivotally mounted to said support;

a first operator control element connectable to said primary speed control lever for movement of said first operator control element and said primary speed control lever in a first plane; and a second operator control element connectable to said primary speed control lever for movement of said second operator control element and said primary speed control lever within a second plane and in said first plane, respectively, said first and second planes disposed at an angle with respect to one another.

12. The speed control assembly kit of claim 11, wherein said first operator control element comprises a knob connectable to an end of said primary speed control lever.

13. The speed control assembly kit of claim 11, wherein said first operator control element comprises a cable connectable to an end of said primary speed control lever.

14. The speed control assembly kit of claim 11, wherein said second operator control element comprises a knob and lever connectable to said primary speed control lever via a right angle connection.

15. The speed control assembly kit of claim 14, wherein said right angle connection comprises a pin and slot connection.

16. The speed control assembly kit of claim 14, wherein said right angle connection comprises a rack and pinion gear mesh.

17. The speed control assembly kit of claim 11, wherein said second operator control element comprises a cable and lever connectable to said primary speed control lever via a right angle connection.

18. In combination:

an internal combustion engine including an engine cover member having an elongated opening therein; and a speed control assembly, comprising:

a support mounted to said engine;

a primary speed control lever pivotally mounted to said support, said primary speed control lever including at least first and second operator control element interfaces; and an operator control element connected to at least one of said operator control element interfaces, said operator control element movable to pivot said primary speed control lever with respect to said support, said operator control element extending through, and translatable within, said elongated opening in said engine cover member.

19. The combination of claim 18, wherein said operator control element comprises one of a manually actuable knob and a cable.

20. The combination of claim 18, wherein said operator control element comprises a secondary speed control lever connected to said primary speed control lever, said secondary speed control lever pivotally mounted to said support for movement within a plane perpendicular to a plane within which said primary speed control lever is movable.

* * * * *